US005566906A

United States Patent [19]

Kamada et al.

[11] Patent Number: 5,566,906

[45] Date of Patent: Oct. 22, 1996

[54] DECURLING DEVICE FOR A ROLLED RECORDING PAPER

[75] Inventors: Takeshi Kamada, Atsugi; Kenichi Takehara, Tokyo, both of Japan

[73] Assignee: Ricoh Company, Ltd., Tokyo, Japan

[21] Appl. No.: 118,649

[22] Filed: Sep. 10, 1993

[30] Foreign Application Priority Data

Sep. 16, 1992 [JP] Japan ..... 4-272430

[51] Int. Cl.[6] ..... B65H 23/34; G01D 15/24; B41J 11/00; G03B 1/48

[52] U.S. Cl. ..... 242/563; 346/136; 242/564.4; 242/566; 226/196; 347/218

[58] Field of Search ..... 346/136; 162/271, 162/270, 197; 226/11, 43, 196, 88, 168; 347/218, 219; 242/563, 564.4, 566

[56] References Cited

U.S. PATENT DOCUMENTS 3,604,652 7/1969 Sleeper ..... 242/419.2

3,743,154 7/1973 Brewitz ..... 226/196 X 5,123,895 6/1992 Mandel ..... 162/271

FOREIGN PATENT DOCUMENTS 61-169442 7/1986 Japan ..... 226/168

*Primary Examiner*—Benjamin R. Fuller

*Assistant Examiner*—David Yockey

*Attorney, Agent, or Firm*—Oblon, Spivak, McClelland, Maier & Neustadt, P.C.

[57] ABSTRACT

A decurling device wherein paper is transported from a roll while being decurled by a decurling roller. A controller controls the decurling by temporarily stopping rotation of the decurling roller. Particular embodiments include provision of a pressing plate pressing the paper toward the decurling roller and control of the roller in accordance with curl of the paper by detection of diameter of the roll and by detection of path the paper follows during feeding.

4 Claims, 10 Drawing Sheets

DECURLING DEVICE FOR A ROLLED RECORDING PAPER

BACKGROUND OF THE INVENTION

The present invention relates to a facsimile machine, printer or similar image recorder of the kind using a recording paper in the form of a roll and, more particularly, to a decurling device capable of decurling a paper paid out from a roll effectively with a simple construction.

It has been customary with an image recorder of the kind described to use a recording paper implemented as a roll. The problem with a rolled paper is that transportability and stackability are low due to curls particular thereto. To eliminate this problem, the image recorder is usually provided with a decurling device for straightening out the paper. While various types of decurling devices have heretofore been proposed, each of them has merits and demerits.

SUMMARY OF THE INVENTION

It is, therefore, an object of the present invention to provide a simple and economical decurling device capable of decurling a paper adequately at all times without regard to the size of a curl.

In accordance with the present invention, a device for decurling a recording paper in the form of a roll comprises a decurling section for decurling the recording paper while the recording paper is in transport, and a controller for temporarily interrupting the transport of the recording paper at the decurling section.

Also, in accordance with the present invention, a device for decurling a recording paper in the form of a roll comprises a decurling section for decurling the recording paper while the recording paper is in transport, a driver for driving the decurling section, a roll diameter sensing member for sensing the diameter of the roll, and a controller for controlling the driver in response to an output of the roll diameter sensing member.

Further, in accordance with the present invention, a device for decurling a recording paper in the form of a roll comprises a decurling section for decurling the recording paper while the recording paper is in transport, a driver for driving the decurling section, a curl sensing member for sensing the size of a curl of the recording paper, and a controller for controlling the driver in response to an output of the curl sensing member.

Moreover, in accordance with the present invention, a device for decurling a recording paper in the form of a roll comprises a decurling roller for bending the recording paper in a direction opposite to the curl direction of the recording paper, and a pressing plate rotatable about a fulcrum and held in pressing contact with the decurling roller at an inlet side and an outlet side with respect to an intended direction of paper transport. The position of the fulcrum and the positions where the pressing plate contacts the decurling roller are selected such that a force acting on the inlet side is greater than a force acting on the outlet side.

BRIEF DESCRIPTION OF THE DRAWINGS

The above and other objects, features and advantages of the present invention will become more apparent from the following detailed description taken with the accompanying drawings in which.

In the figures, the same or similar constituent parts are designated by like reference numerals.

DESCRIPTION OF THE PREFERRED EMBODIMENTS

Figure 9:
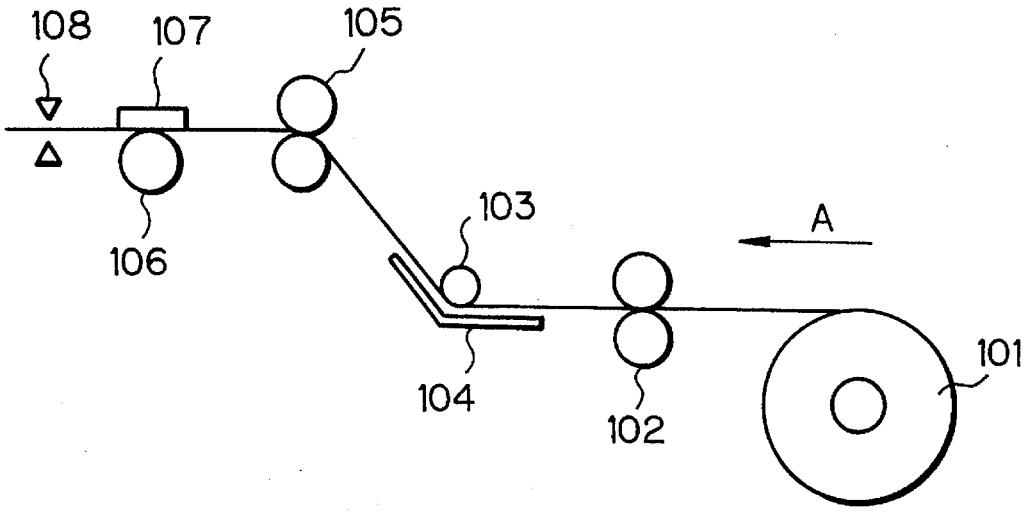
Fig. 9 PRIOR ART
FIGS. 9, 10, 11 and 12 are sections each showing a different conventional decurling device.

To better understand the present invention, a brief reference will be made to a conventional decurling device, shown in FIG. 9. There are shown in the figure a paper roll 101, a feed roller 102 for paying out the paper from the roll 101 in a predetermined direction, and a decurling roller 103 and a decurling guide 104 which play the role of decurling means in combination. Also shown in the figure are a transport roller 105 for driving the paper 101 in a predetermined direction, a platen roller 106, a thermal head 107 for printing images on the paper 101, and a cutter 108 for cutting a predetermined length of the paper 101. In operation, the paper 101 is paid out from the roll by the feed roller 102, as indicated by an arrow A in the figure. While the decurling guide 104 guides the paper 101 to the decurling roller 103, the roller 103 bends the paper 101 in a direction opposite to the curl direction so as to decurl it. The transport roller 105 drives the decurled paper 101 to a recording station where the thermal head 107 and platen roller 106 are located. After image data has been printed on the paper 101 at the recording station, the cutter 108 cuts a predetermined length of the paper 101. The cut length of the paper, or sheet, is driven out of the image recorder.

The decurling device described above has a problem that the outside diameter of the decurling roller 103 cannot be reduced beyond a certain limit in respect of mechanical strength. As a result, the decurling roller 103 has a large outside diameter, or radius of curvature, failing to exhibit an expected decurling effect. Specifically, when the roll has a large diameter, i.e., when the size of a curl is small, even such a roller 103 can decurl the paper 101 sufficiently. However, the roller 103 cannot do so when the diameter of the roll is small as measured in the vicinity of the core, i.e., when the size of curl is large.

Figure 10:
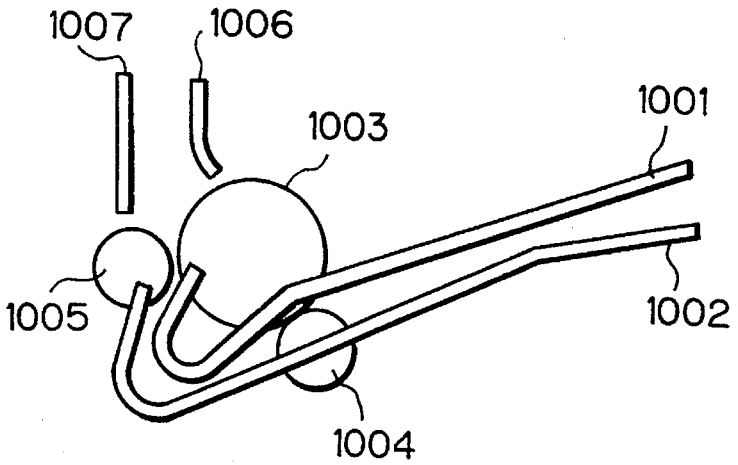
Fig. 10 PRIOR ART

FIG. 10 shows a decurling device taught in Japanese Patent Publication No. 33622/1990 and constructed to eliminate the above-discussed problem. As shown, this decurling device has an upper guide 1001, a lower guide 1002, a drive roller 1003, an inlet tension roller 1004, an outlet tension roller 1005, a right guide 1006, and a left guide 1007. The inlet and outlet tension rollers 1004 and 1005 are each pressed against the drive roller 1003 by a particular pressure. The upper and lower guides 1001 and 1002 include an about 130 degrees curved portion for decurling the paper 101.

With this configuration, it is possible to decurl the paper 101 sufficiently when the roll diameter as measured in the vicinity of the core is small, i.e., when the size of a curl is large. However, when the roll diameter is large, i.e., when the size of a curl is small, an excessive decurling force acts on the sheet 101 with the result that the sheet 101 is curled in the opposite direction.

Figure 11:
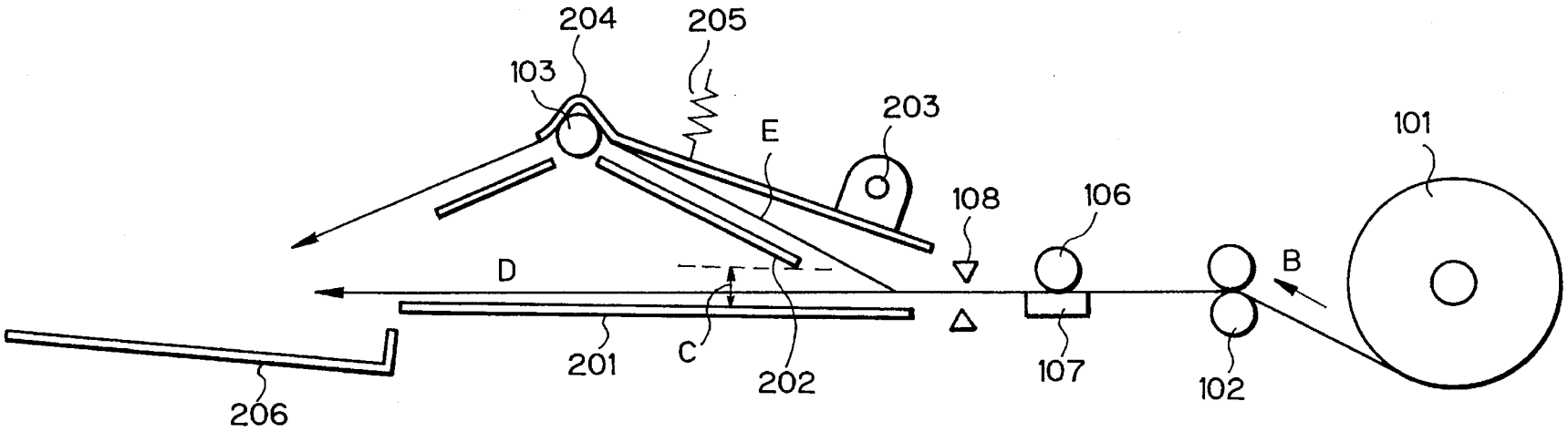
Fig. 11 PRIOR ART

In the light of the above, there has also been proposed a decurling device capable of decurling only the paper 101 having a noticeable curl. Specifically, as shown in FIG. 11, a decurling device with such a capability includes a branch guide 202 having a height C at the inlet portion thereof. When the size of the curl of the paper 101 is smaller than the height C, the paper 101 is directly driven out without being decurled (transport path D). When the size is larger than the height C, the paper 101 is decurled by the decurling roller 103 and a pressure plate 204 (transport path E).

Figure 12:
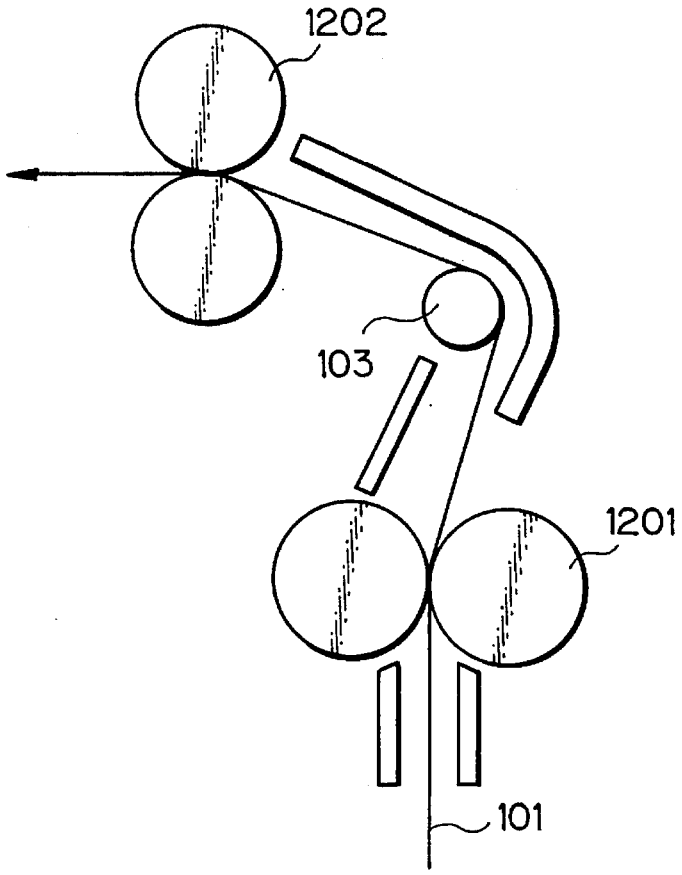
Fig. 12 PRIOR ART

FIG. 12 shows a decurling device disclosed in Japanese Patent Publication No. 44217/1985. As shown, the decurling device has a feed roller 1201, a discharge roller 1202, and the decurling roller 103 intervening between the rollers 1201 and 1202. The rollers 1201 and 1202 each transports the paper 101 at a particular speed, or each has a particular coefficient of friction. In operation, while the decurling roller 103 bends the paper 101 in the direction opposite to the curl direction, the rollers 1201 and 1202, each having a particular transport speed or a particular coefficient friction, transports it. As a result, the curl of the paper 101 is removed.

Figure 13:
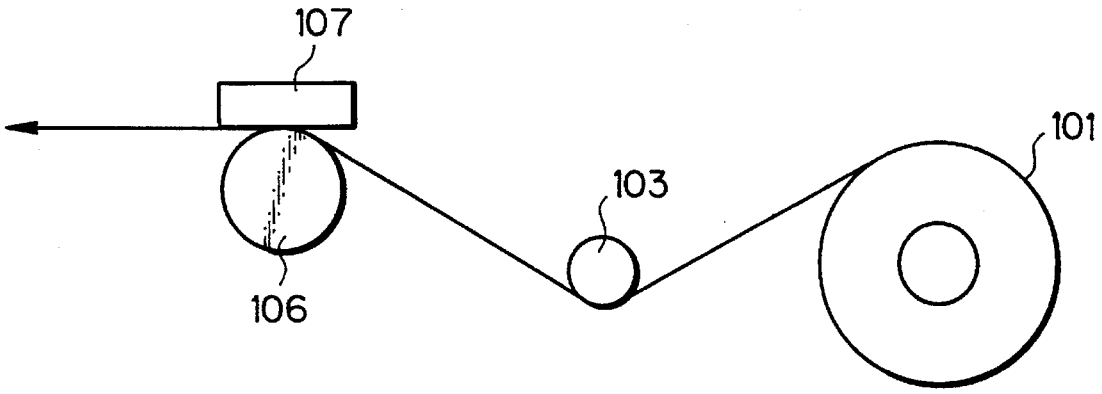
Fig. 13 PRIOR ART
FIG. 13 is a section of an image recorder incorporating a conventional decurling device and implemented as a facsimile receiver.

A facsimile receiver implemented with a conventional decurling device is shown in FIG. 13. As shown, the decurling roller 103 is located between the paper roll 101 and the thermal head 107.

Other decurling implementations using a roller, guides and so forth are proposed in Japanese Patent Publication No. 57019/1989, Japanese Utility Model Publication No. 33882/1988, Japanese Patent Laid-Open Publication (Kokai) No. 86569/1991, etc.

However, the conventional decurling devices stated above have various problems left unsolved, as follows. To begin with, the device shown in FIG. 11 cannot remove curls sufficiently since it distinguishes them on a simple two-rank basis. With the device of FIG. 12, it is difficult to straighten out the paper 101 at all times since the device fails to decurl the paper 101 sufficiently when the size of the curl is great in the vicinity of the core of the roll. In addition, the device of FIG. 12 needs many constituent parts, including a plurality of rollers, and a complicated construction. In the device shown in FIG. 13, since the decurling station precedes the recording station, the paper 101 is curled at the decurling station when left unused for a long time.

Figure 1:
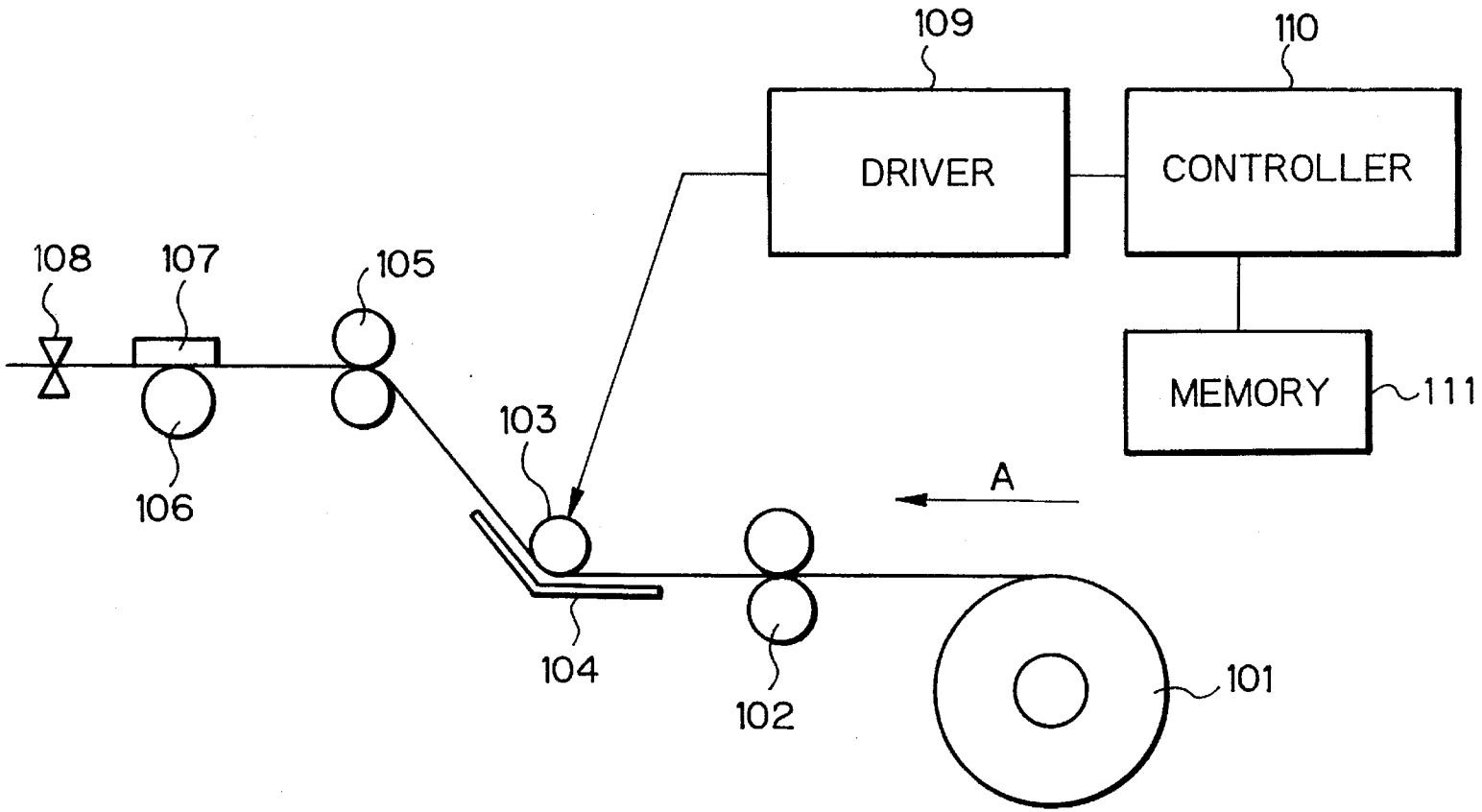
FIGS. 1 and 2 are sections respectively showing image recorders implemented with a first and a second embodiment of the decurling device in accordance with the present invention.

Referring to FIG. 1, there is shown an image recorder implemented with a first embodiment of the decurling device in accordance with the present invention. As shown, the image recorder is loaded with a paper roll 101 made up of a core, e.g., a paper tube and a paper wound thereon. A feed roller 102 is rotatable while nipping the paper 101. A decurling roller 103 transports the paper 101 such that the paper 101 bends in a direction opposite to the curl thereof. A decurling guide 104 is located to face the decurling roller 103 and bent in the direction opposite to the curl direction of the paper 101. A transport roller 105 drives the paper 101 decurled by the roller 103 and guide 104. A reversible platen roller 106 has a highly smooth surface and rotates with the paper 101 passed thereover. A thermal head 107 has a number of recording electrodes matching a desired recording density and arranged to cover a single line. A cutter 108 cuts a predetermined length of the paper 101 after image data has been recorded on the paper 101. A driver 109 drives the decurling roller 103. A controller 110 sends drive signals and other signals to the driver 109. A memory 111 stores, e.g., a control program to be executed by the controller 110.

In operation, as the feed roller 102 pays out the paper 101 in a direction indicated by an arrow A in the figure, the paper 101 is transported to the decurling roller 103 along the decurling guide 104. The decurling roller 103 bends the paper 101 in the direction opposite to the curl direction of the paper 101 while transporting it. At this instant, the controller 110 temporarily stops the rotation of the decurling roller 103 at a predetermined timing. This allows a noticeably curled portion, which may be included in the paper 101, to be decurled in a desirable manner. The decurled paper 101 is transported one line at a time, while being pressed against the thermal head 107 and platen roller 106. At the same time, the recording electrodes of the thermal head 107 are selectively energized on the basis of an image signal, thereby recording an image represented by the image signal in the paper 101. Subsequently, a predetermined length of the paper 101 is cut by the cutter 108, and the cut length of paper is driven out of the image recorder.

Figure 2:
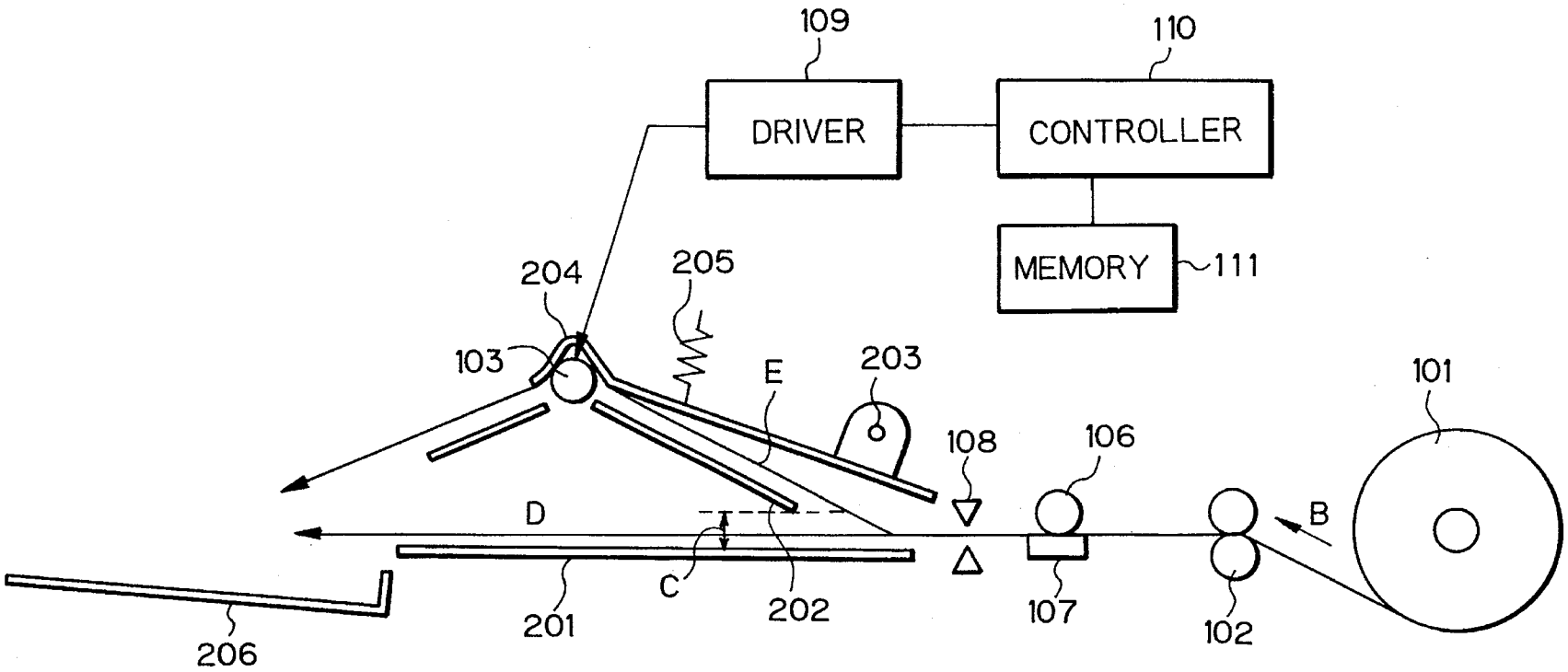

FIG. 2 shows an image recorder incorporating a second embodiment of the present invention which decurls the paper 101 after the image recording step. As shown, a lower guide 201 guides the piece of paper 101 cut off by the cutter 108. A branch guide 202 guides the paper 101 to a position where the decurling roller 103 is located. The inlet end of the branch guide 202 is spaced apart from the surface of the lower guide 201 by a gap C. The decurling roller 103 is located above the branch guide 202. A pressing plate 204 is rotatable about a fulcrum 203. A spring 205 constantly biases the end of the pressing plate 204 remote from the fulcrum 203 in a predetermined direction, thereby urging the plate 204 against the decurling roller 103. A tray 206 is provided for stacking the decurled papers 101.

The operation of the image recorder shown in FIG. 2 is as follows. The paper 101 is paid out from the roll by the feed roller 102 in a direction indicated by an arrow B. While the paper 101 is transported, one line at a time, in contact with the thermal head 107 and platen roller 106, the recording electrodes of the thermal head 107 are selectively energized on the basis of an image signal. As a result, an image represented by the image signal is recorded in the paper 101. A predetermined length of the paper 101 carrying the image is cut off by the cutter 108. When the size, i.e., height of the cut paper 101 is smaller than the gap C, the paper 101 is driven out to the tray 206 via the space between the lower guide 201 and the branch guide 202 (transport path D); that is, the decurling device remains inoperative when the size of a curl is small. On the other hand, when the size of the curl of the paper 101 is greater than the gap C, the paper 101 is introduced into the space between the branch guide 202 and the pressing plate 204 (transport path E). On reaching the decurling roller 103, the paper 101 is bent in the direction opposite to the curl direction thereof. At this instant, the controller 110 temporarily interrupts the rotation of the decurling roller 103 at a predetermined timing. This is successful in straightening out a noticeably curled portion in a desirable manner. The decurled paper 101 is discharged to the tray 206.

Figure 3:
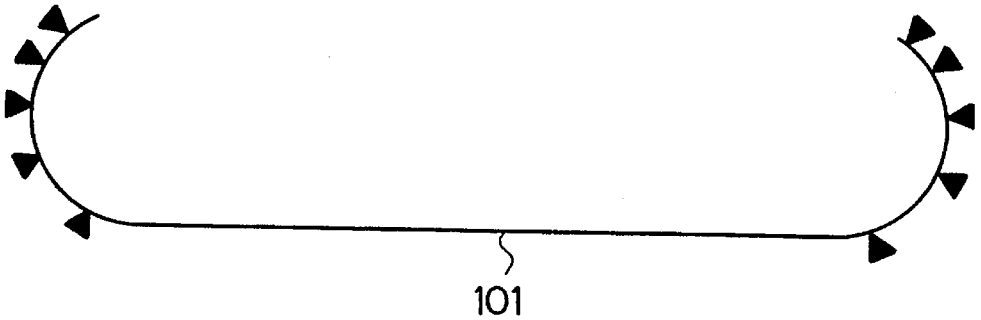
FIG. 3 shows a paper which has not undergone decurling.
Figure 4:
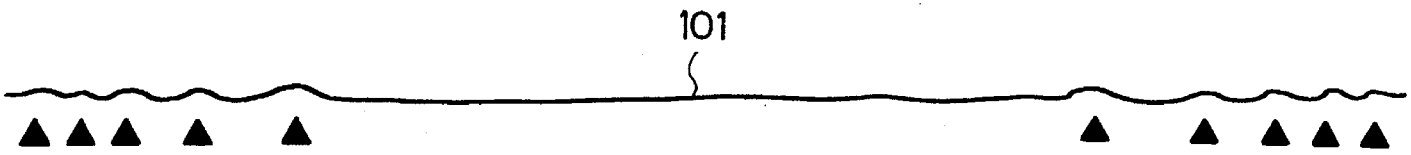
FIG. 4 shows a paper which has undergone decurling.

Now, the paper 101 appears as shown in FIG. 3, when not decurled at all. As shown, the weight of the paper 101 influences the paper 101 less at the leading and trailing edge portions than at the other portion, causing such end portions to rise or curl. It follows that at the decurling station, the paper 101 should advantageously be temporarily stopped at one or both of the trailing and leading edge portions. Further, it is preferable to effect the temporary stop of the paper 101 at a smaller pitch as the distance from the edge decreases. By such control, it is possible to substantially straighten out the paper 101, as shown in FIG. 4. In FIGS. 3 and 4, black triangles are indicative of positions where the paper 101 is temporarily stopped.

Figure 5:
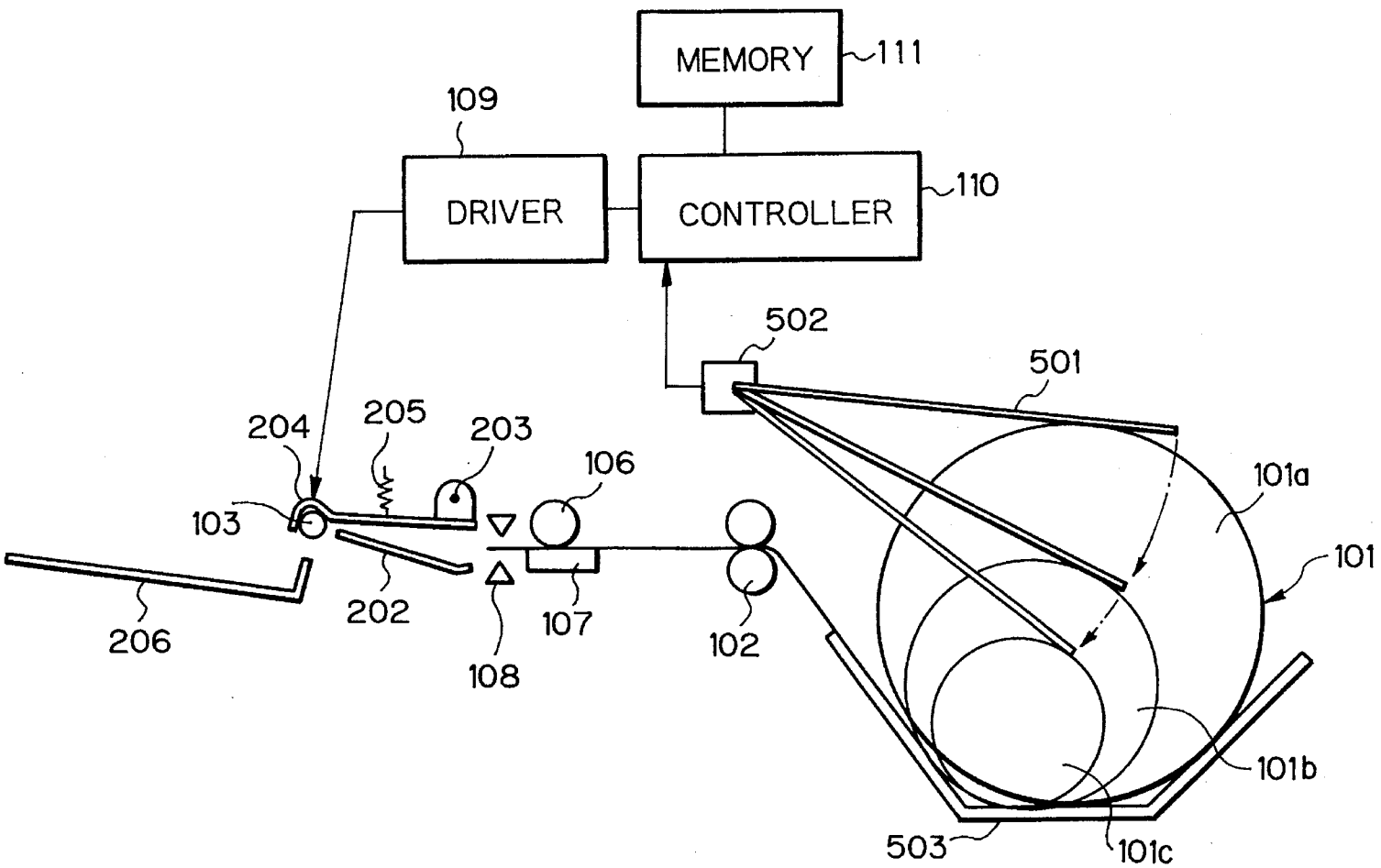
FIGS. 5, 6 and 7A and 7B are sections respectively showing, a third, a fourth and a fifth embodiment of the present invention.

Referring to FIG. 5, an image recorder implemented with a third embodiment of the present invention will be described. As shown, an arm 501 is held in contact with the paper roll 101. The paper roll 101 has a large diameter when it is new, as represented by 101*a* in the figure. The diameter 101*a* sequentially decreases to a medium diameter 101*b* and then to a small diameter 101*c* (close to the core). Contacting the roll 101, the arm 501 moves in association with such a change in the diameter of the roll 101. A variable resistor 502 is associated with a fulcrum about which the arm 501 is rotatable, thereby sensing the varying roll diameter. Specifically, the resistance of the variable resistor 502 changes with a change in the angular position of the arm 501. The output of the variable resistor 502 is sent to the controller 110 to control the timing, frequency and duration of the interruption of paper transport to occur at the decurling station. The reference numeral 503 designates a holder on which the roll is set.

In operation, the controller 110 determines the diameter (101*a*–101*c*) of the roll 101 via the variable resistor 502 and arm 501. Thereafter, the thermal head 107 and platen roller 106 located at the recording section records image data in the paper 101 paid out from the roll by the feed roller 102. The cutter 108 cuts a predetermined length of the paper 101 carrying an image thereon. The resulting piece of paper, or sheet, 101 is transported until the leading edge thereof reaches the decurling roller 103 by way of the path between the pressing plate 204 and the guide 202. The decurling roller bends the paper 101 in the opposite direction to the curl direction in cooperation with the pressing roller 204, while transporting it. The controller 110 controllably drives the driver 109 to interrupt the sheet transport a number of times or a period of time matching the varying diameter of the roll 101 (101*a*, 101*b* and 101*c*). Finally, the sheet 101 substantially straightened out is driven out to the tray 206.

As stated above, at the decurling station, the frequency and duration of the interruption of transport are adequately controlled in matching relation to the varying diameter of the roll 101 (101*a*–101*c*). This prevents, for example, a paper 101 paid out from a new roll (great diameter; small curl) from being curled in the opposite direction, i.e., decurled excessively. At the same time, when the roll diameter is small (great curl), the paper 101 is decurled to a sufficient degree.

In the embodiment shown in FIG. 5, the means for determining the amount of curl may alternatively be implemented as a weight sensor responsive to the weight of the roll, or a counter responsive to the number of steps of a pulse motor.

Figure 6:
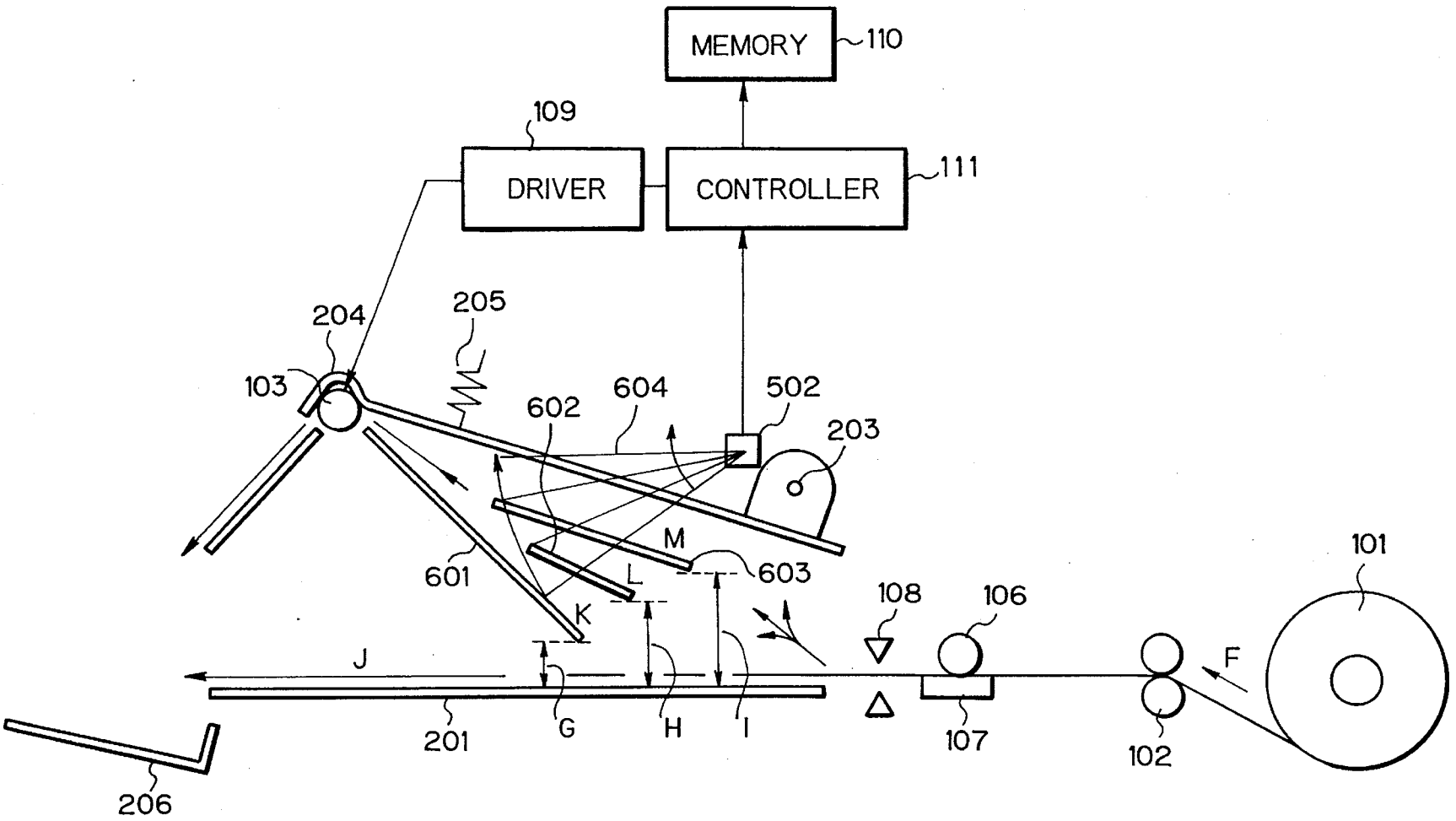

FIG. 6 shows an image recorder incorporating a fourth embodiment of the present invention and having curl sensing means and a decurling station at the downstream side of a recording station. As shown, the embodiment has a first guide 601, a second guide 602, and a third guide 603. The first guide 601 is spaced from the lower guide 201 by a gap G (transport path J). The second guide 602 is spaced from the lower guide 201 by a gap H (transport path K). Further, the third guide 603 is spaced from the lower guide 201 by a gap I (transport path L). The third guide 603 and pressing plate 204 define a transport path M therebetween. An arm 604 is rotatable about the variable resistor 502 and suspended to extend throughout the transport paths J–M, as illustrated. The resistance of the variable resistor 502 changes with a change in the angular position of the arm 501, as in the embodiment of FIG. 5. The output of the variable resistor 502 is fed to the controller 110 to control the timing, frequency and duration of the interruption of transport to occur at the decurling station.

In operation, as the paper 101 is fed by the feed roller 102 in a direction indicated by an arrow F in FIG. 6, the platen roller 106 and thermal head 107 located at a recording station record received image data in the paper 101. The cutter 108 cuts a predetermined length of the paper 101 carrying an image thereon. When the height of the curl of the cut paper or sheet 101 is smaller than the gap G, the paper 101 is introduced into the transport path J. When the curl height is greater than the gap G but smaller than the gap H, the paper 101 is introduced into the transport path K. When the curl height is greater than the gap H but smaller than the gap I, the paper 101 is introduced into the transport path L. Further, when the curl height is greater than the gap I, the paper 101 is introduced into the transport path M. The paper 101 passed the transport path J is directly discharged to the tray 206. On the other hand, the sheet 101 passed the transport path K, L or M is adequately decurled by the decurling roller 103 and pressing plate 204 (intermittent drive of the roller 103) on the basis of the curl thereof and then driven out to the tray 206.

The decurling operation matching the amount of curl will be described more specifically. As the paper 101 passed the transport path K, L or M abuts against the arm 604, it raises the arm 604. The resulting displacement of the arm 604 is detected in terms of a change in the resistance of the variable resistor 502. On receiving the output of the variable resistor 502, the controller 111 determines the amount of curl of the paper 101. Then, the controller 111 controls the frequency and/or duration of the interruption of transport at the decurling station by controlling the driver 109 on the basis of the size of the curl. This allows the curl of the paper 101 to be removed more effectively.

Figure 7A:
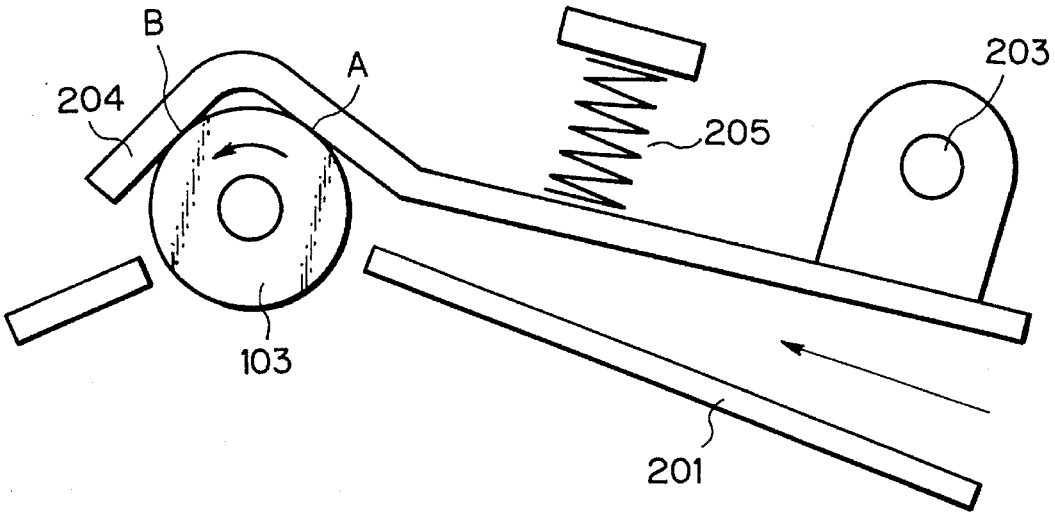
Figure 7B:
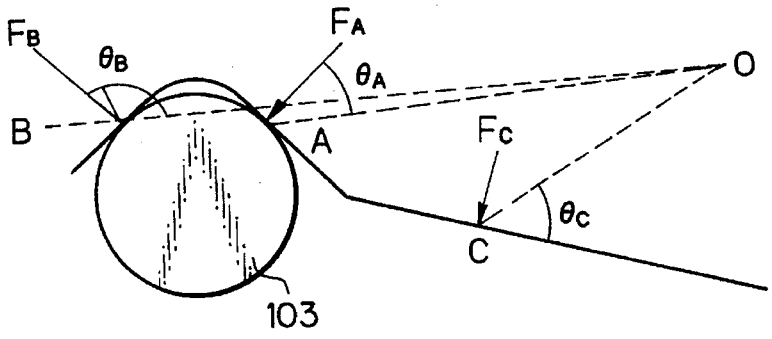

Referring to FIGS. 7A and 7B, an image recorder using a fifth embodiment of the present invention is shown. FIG. 7A shows a decurling section identical with that of FIG. 2 while FIG. 7B shows a relation between the fulcrum position and the pressing position of FIG. 7A. In FIG. 7B, O is representative of the fulcrum 203 of the pressing plate 204, and A and B are representative of points where the pressing plate 204 contacts the decurling roller 103 at the inlet side and the outlet side, respectively. Also shown in FIG. 7B a pressing position C, a pressure $F_A$ acting on the inlet side, a pressure $F_B$ acting on the outlet side, a force $F_C$ exerted by the spring 205, an angle $\theta_A$ between $F_A$ and OA, an angle $\theta_B$ between $F_B$ and OB, and an angle $\theta_C$ between $F_C$ and the pressing plate 204.

In the above configuration, the paper 101 is transported toward the decurling station over the path defined by the pressing plate 204 and branch guide 201, as indicated by an arrow in FIG. 7A. The pressing plate 204 is constantly urged against the decurling roller 103 about the fulcrum 203 by the spring 205. As the leading edge of the paper 101 reaches the decurling roller 103, the pressing plate 204 presses it against the roller 103 at the points A and B. The pressing plate 204 has a spoon-like cross section, rather than an L-shaped cross-section, so as to exert a force in a direction perpendicular to the tangent at each of the points A and B. Further, the pressure $F_A$ at the inlet side is maintained greater than the pressure $F_B$ at the outlet side by the following condition:

$$OB/OA < \sin\theta_B/\sin\theta_A \quad \text{Eq. (1)}$$

where $\theta_C$ is smaller than $\pi/2$.

When the pressure condition at the decurling station is so selected as to satisfy the above Eq. (1), a tension acts on the paper 101 between the points A and B due to the relation of $F_A > F_B$. As a result, the paper 101 is drawn in the opposite direction to the curl direction and, therefore, straightened out.

Even when the outside diameter of the decurling roller 103 is about 4 millimeters to 6 millimeters, it can exert a sufficient decurling force on the paper 101. Moreover, the above configuration provides the fulcrum 203 with a margin great enough to eliminate adjustment. This enhances easy assembly and maintenance and, in addition, eases accuracy requirement to promote easy machining.

The surface of the pressing plate 204 to contact the paper may be implemented by a low friction member, e.g., a Teflon coating. Then, the pressing plate 204 will be prevented from moving in the direction of rotation of the decurling roller 103, i.e., from lowering the pressure at the outside side. Consequently, the decurling device can be implemented by a minimum number of constituent parts and a simple arrangement while achieving an even higher decurling ability.

Furthermore, since the pressing plate 203 is rotatable about the fulcrum 203 toward and away from the decurling roller 103, the paper 101 can be removed easily when it jams the transport path around the pressing plate 203. This is also desirable from the maintenance standpoint.

Figure 8:
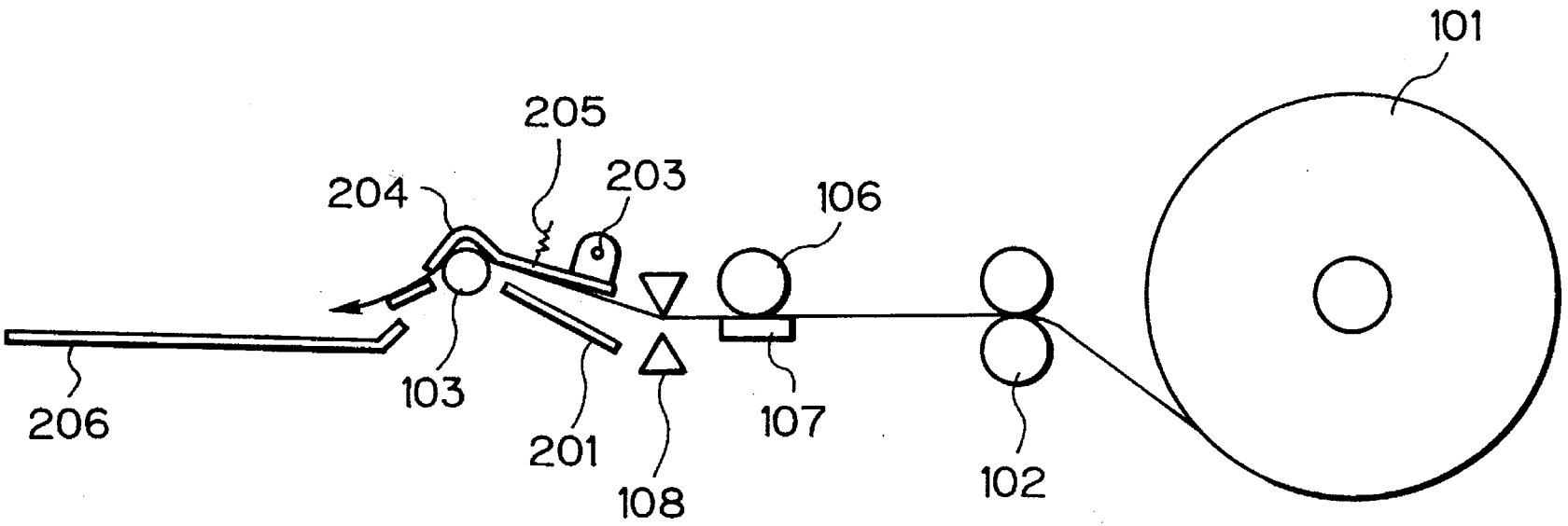
FIG. 8 shows an image recorder with a decurling device in accordance with the present invention.

FIG. 8 shows an image recorder incorporating the above-described decurling device. As shown, the image recorder decurls the paper 101 after an image has been recorded in the paper 101. In this condition, the paper 101 is prevented from being continuously nipped by the decurling section when the image recorder is left unused for a long time; otherwise, the paper 101 would be curled by the decurling section. Moreover, since the platen roller 106 and the decurling roller 103 may respectively play the role of the feed roller 102 and the transport roller, the number of necessary parts and, therefore, the overall cost of the image recorder is reduced.

In summary, it will be seen that the present invention provides a simple and economical decurling device capable of decurling a paper adequately at all times without regard to the size of a curl. Specifically, in accordance with the present invention, when a paper is transported while being decurled by the decurling device, a controller temporarily deactivates the decurling device on the basis of the size of the curl of the paper. The deactivation is effected at one or both of the leading and trailing edges of the paper. The size of a curl is determined in terms of a roll diameter or based on the size itself. The frequency and duration of the deactivation are changed in matching relation to the size of a curl so as to straighten out the paper adequately. Further, a fulcrum position and pressing positions are selected such that the pressure to act between a decurling roller and a pressing plate is higher at an inlet side than at an outlet side, thereby causing a tension to act on the paper. The tension draws the paper in a direction opposite to the curl direction of the paper.

Various modifications will become possible for those skilled in the art after receiving the teachings of the present disclosure without departing from the scope thereof.

What is claimed is:

1. A device for decurling a recording paper in a form of a roll, the device comprising:

means for transporting the recording paper;

decurling means for decurling said recording paper while said recording paper is in transport, said decurling means comprising a decurling roller and decurling guide; and control means for temporarily interrupting transport of said recording paper at said decurling means, said control means comprising a driver for driving the decurling roller and a controller which provides control signals to said driver;

wherein said controller controls said driver to temporarily stop a rotation of the decurling roller at a predetermined timing so as to control at least one of a duration and a frequency of interruption of the transport of the recording paper, and said controller controls the driver to temporarily stop said decurling roller rotation at said predetermined timing so as to permit a decurling of the recording paper at said decurling means;

the device further comprising curl sensing means for sensing a curl of the recording paper, wherein said control means controls the transport of the recording paper in response to an output of said curl sensing means.

2. A device for decurling a recording paper in a form of a roll, the device comprising:

means for transporting the recording paper;

decurling means for decurling said recording paper while said recording paper is in transport;

driving means for driving said decurling means;

roll diameter sensing means for sensing a varying diameter of said roll; and control means for controlling said driving means to interrupt the transport of the recording paper a number of times or a period of time in response to an output of said roll diameter sensing means.

3. A device for decurling a recording paper in a form of a roll, the device comprising:

means for transporting the recording paper;

decurling means for decurling said recording paper while said recording paper is in transport, said decurling means comprising a decurling roller;

driving means for driving said decurling roller of said decurling means;

curl sensing means for sensing a size of a curl of said recording paper; and control means for controlling said driving means to interrupt a rotation of said decurling roller at a predetermined timing in response to an output of said curl sensing means indicating that a size of the curl of the recording paper is greater than a predetermined size.

4. A device for decurling a recording paper in a form of a roll, the device comprising:

transporting means for transporting the recording paper along a lower paper guide;

a decurling roller for bending said recording paper in a direction opposite to a curl direction of said recording paper;

a pressing plate rotatably mounted on a fulcrum so as to be rotatable about the fulcrum, an end of the pressing plate spaced from the fulcrum defining a bent portion which partially surrounds said decurling roller, said pressing plate being spring biased by a spring to rotate about the fulcrum in a direction toward the decurling roller so as to cause said bent portion to contact said decurling roller at a first portion of the decurling roller which defines an inlet side of the decurling roller with respect to an intended direction of paper transport, and at a second portion of the decurling roller which defines an outlet side of said decurling roller with respect to the intended direction of paper transport; and a plurality of paper guide plates positioned after said transporting means and before said decurling roller with respect to the intended direction of paper transport, and positioned between said pressing plate and said lower paper guide so as to be spaced from each other to define a plurality of recording paper transport paths which lead to said decurling roller, wherein each of said transport paths guides recording paper with different curl sizes to said decurling roller;

a position of said fulcrum and positions of the first and second portions of the decurling roller where said bent portion of said pressing plate contacts said decurling roller being selected such that a force acting on said inlet side is greater than a force acting on said outlet side so as to create a tension on the recording paper between said inlet side and said outlet side.

* * * * *